US008590348B1

(12) United States Patent
Skjellerup et al.

(10) Patent No.: US 8,590,348 B1
(45) Date of Patent: Nov. 26, 2013

(54) SECURITY TAG ASSEMBLY

(75) Inventors: Johan Skjellerup, Boca Raton, FL (US); Eddie L. Stenild, Dragor (DK)

(73) Assignees: Braebum Asset Holdings, LLC. (BS); ES Holding Dragoer APS (DK)

( * ) Notice: Subject to any disclaimer, the term of this patent is extended or adjusted under 35 U.S.C. 154(b) by 1 day.

(21) Appl. No.: 13/285,607

(22) Filed: Oct. 31, 2011

(51) Int. Cl.
*E05B 65/00* (2006.01)

(52) U.S. Cl.
USPC ..... 70/57.1; 24/704.1; 24/704.2; 24/706.8; 70/276; 70/386; 340/572.9

(58) Field of Classification Search
USPC ..... 70/57.1, 276, 386; 292/307 A; 24/704.1, 24/704.2, 706.8; 340/572.1, 572.8, 572.9
See application file for complete search history.

(56) References Cited

U.S. PATENT DOCUMENTS

| | | | |
|---|---|---|---|
| D205,049 | S | 6/1966 | Brady |
| 3,974,581 | A | 8/1976 | Martens et al. |
| 4,104,622 | A | 8/1978 | Van Niel |
| 4,299,870 | A | 11/1981 | Humble |
| 4,339,853 | A | 7/1982 | Lipschitz |
| 4,510,489 | A | 4/1985 | Anderson, III et al. |
| 4,523,356 | A | 6/1985 | Charlot, Jr. |
| 4,527,310 | A | 7/1985 | Vandebult |
| 4,590,461 | A | 5/1986 | Cooper |
| 4,603,453 | A | 8/1986 | Yokoyama |
| 4,651,136 | A | 3/1987 | Anderson et al. |
| 4,670,950 | A | 6/1987 | Wisecup et al. |
| 4,685,234 | A | 8/1987 | Anderson et al. |
| 4,774,503 | A | 9/1988 | Bussard |
| 4,884,833 | A | 12/1989 | Pedersen |
| 4,944,075 | A | 7/1990 | Hogan |
| 4,993,245 | A | 2/1991 | Ott |
| 5,031,287 | A | 7/1991 | Charlot, Jr. et al. |
| 5,054,172 | A | 10/1991 | Hogan et al. |
| 5,077,872 | A | 1/1992 | Guthammar |
| 5,088,165 | A | 2/1992 | Minasy et al. |
| 5,151,684 | A | 9/1992 | Johnsen |
| 5,205,024 | A | 4/1993 | Willard |
| 5,208,580 | A | 5/1993 | Crossfield |
| D343,134 | S | 1/1994 | Witzky |
| D343,135 | S | 1/1994 | Witzky |
| D344,033 | S | 2/1994 | Davidge |
| 5,347,262 | A | 9/1994 | Thurmond et al. |

(Continued)

FOREIGN PATENT DOCUMENTS

| | | | |
|---|---|---|---|
| BE | 1004849 | A7 | 2/1993 |
| DE | 20014860 | U1 | 10/2000 |

(Continued)

*Primary Examiner* — Lloyd Gall
(74) *Attorney, Agent, or Firm* — Malloy & Malloy, P.L.

(57) ABSTRACT

A security tag assembly structured to restrict unauthorized removal of merchandise from a designated area is presented. The security tag assembly comprises a base and a tag member removably connected to the merchandise being protected or monitored. A locking assembly is disposed within the base and is structured to be biased into a locking orientation relative to a connector pin of the tag member. A release assembly, also disposed within the base, is structured to facilitate the authorized release of the locking assembly upon contact with an externally applied detachment assembly. In particular the release assembly comprises first and second members disposed in a movable interlocked relation with one another, wherein the first member is structured to be rotationally disposed upon contact with the detachment assembly. The second member is structured for disposition into a displacing engagement with the locking assembly upon the rotational movement of the first member.

26 Claims, 15 Drawing Sheets

(56) References Cited

U.S. PATENT DOCUMENTS

| | | | | |
|---|---|---|---|---|
| 5,367,289 | A | 11/1994 | Baro et al. | |
| D354,924 | S | 1/1995 | Garner et al. | |
| 5,426,419 | A | 6/1995 | Nguyen et al. | |
| 5,497,639 | A | 3/1996 | Charlot, Jr. | |
| 5,587,703 | A | 12/1996 | Dumont | |
| 5,600,977 | A | 2/1997 | Piron | |
| 5,613,384 | A | 3/1997 | Weber et al. | |
| 5,748,089 | A | 5/1998 | Sizemore | |
| 5,786,762 | A | 7/1998 | Liu | |
| D410,400 | S | 6/1999 | Skjellerup | |
| 5,912,622 | A | 6/1999 | Endo et al. | |
| 5,942,978 | A | 8/1999 | Shafer | |
| 5,942,987 | A | 8/1999 | Heinrich et al. | |
| 5,955,951 | A | 9/1999 | Wischerop et al. | |
| 6,023,951 | A | 2/2000 | Maurer et al. | |
| 6,089,453 | A | 7/2000 | Kayser et al. | |
| 6,281,800 | B1 | 8/2001 | Sizemore | |
| 6,348,865 | B1 | 2/2002 | Siegel | |
| D455,363 | S | 4/2002 | Fuss | |
| 6,535,130 | B2 | 3/2003 | Nguyen et al. | |
| 6,722,166 | B2 | 4/2004 | Skjellerup | |
| 6,724,307 | B1 | 4/2004 | Siegel | |
| 6,752,837 | B2 | 6/2004 | Karp | |
| D494,488 | S | 8/2004 | Sayegh | |
| 6,774,794 | B2 | 8/2004 | Zimmerman et al. | |
| 7,073,236 | B2 | 7/2006 | Xue et al. | |
| 7,075,440 | B2 | 7/2006 | Fabian et al. | |
| 7,148,805 | B2 | 12/2006 | Hogan | |
| 7,183,917 | B2 | 2/2007 | Piccoli et al. | |
| 7,190,272 | B2 * | 3/2007 | Yang et al. | 340/572.8 |
| 7,286,054 | B2 | 10/2007 | Skjellerup et al. | |
| 7,347,068 | B2 * | 3/2008 | Seidel | 70/57.1 |
| 7,382,256 | B2 | 6/2008 | Skjellerup et al. | |
| 7,400,254 | B2 * | 7/2008 | Yang et al. | 340/572.1 |
| 7,474,216 | B2 | 1/2009 | Skjellerup et al. | |
| 7,474,222 | B2 * | 1/2009 | Yang et al. | 340/572.8 |
| 7,523,630 | B2 | 4/2009 | Skjellerup | |
| D603,739 | S | 11/2009 | Skjellerup | |
| 7,652,574 | B2 * | 1/2010 | Sayegh | 340/568.1 |
| 7,750,806 | B1 | 7/2010 | Skjellerup et al. | |
| 7,817,041 | B2 | 10/2010 | Skjellerup et al. | |
| 8,051,686 | B2 * | 11/2011 | Garner | 70/57.1 |
| 8,223,022 | B2 | 7/2012 | Skjellerup et al. | |
| 8,242,910 | B2 | 8/2012 | Skjellerup et al. | |
| 2002/0105424 | A1 | 8/2002 | Alicot et al. | |
| 2003/0067397 | A1 | 4/2003 | Trimble | |
| 2004/0070507 | A1 | 4/2004 | Campero | |
| 2004/0231375 | A1 | 11/2004 | Skjellerup | |
| 2004/0233042 | A1 | 11/2004 | Piccoli et al. | |
| 2005/0218218 | A1 | 10/2005 | Koster | |
| 2006/0139176 | A1 | 6/2006 | Skjellerup et al. | |

FOREIGN PATENT DOCUMENTS

| | | | |
|---|---|---|---|
| DE | 202004008789 | U1 | 11/2004 |
| DE | 202004013895 | U1 | 12/2004 |
| EP | 0012923 | A1 | 7/1980 |
| EP | 142748 | | 5/1985 |
| EP | 0404329 | A1 | 12/1990 |
| EP | 0594324 | A4 | 4/1994 |
| EP | 1391574 | | 2/2004 |
| JP | 2005-71143 | | 3/2005 |
| JP | 2006-249364 | | 9/2006 |
| WO | WO2004/106674 | A1 | 12/2004 |
| WO | WO2005/118991 | A1 | 12/2005 |

* cited by examiner

SECURITY TAG ASSEMBLY

BACKGROUND OF THE INVENTION

1. Field of the Invention

The present invention relates to a security tag assembly or system comprising a base and an attachment member removably securable to various types of merchandise. In particular, the security tag assembly comprises a locking assembly structured to restrict unauthorized removal of the tag assembly from the merchandise and a release assembly cooperatively structured to release the locking assembly upon contact with a detachment assembly.

2. Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above known security or anti-theft tags are intended to provide some indication which either renders the merchandise useless or alternatively signals an attempted unauthorized removal.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacture or provider to can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

The present invention is directed to a security tag assembly structured to restrict unauthorized removal of a product or merchandise item from a store or other designated area. In particular, the security tag assembly of the various embodiments disclosed herein includes a base and a tag or attachment member. The base comprises a locking assembly which is disposed therein, preferably in an inaccessible location, and is structured to be biased into a locking orientation. The tag or attachment member comprises an elongated connector pin structured and disposed to pass through the merchandise (e.g., clothing or other garments) and into a locking position with the locking assembly disposed within the base.

In addition, the tag assembly of the invention disclosed herein further includes a release assembly disposed within the base and structured for movable disposition upon contact by an externally applied detachment assembly. Specifically, the release assembly of a preferred embodiment includes a first, outer portion disposed in a surrounding, at least partially concentric relation to a second, inner portion. For instance, the first and second portions are disposed in an interlocked yet movable relation relative to one another such that movement of the first, outer ring or member causes the second, inner ring or member to also move. However, the cooperative dimensions and interconnection of the first and second members causes the second, inner member to move in a different direction than the first, outer member.

Specifically, upon disposition of an externally applied detachment assembly into contact with the first, outer member (e.g., on an aligned and sloped receiving channel), the first member is thereby disposed in at least partially rotational movement (due to the sloped configuration of the receiving channel and the linear movement of the detachment assembly in contact therewith). In addition, due to the configuration of preferably angularly disposed mating surfaces between the interlocked first and second members, upon a rotational disposition of the first member, the second member is disposed into an outwardly displacing engagement with at least a portion of the locking assembly, the displacing engagement being sufficient to dispose the locking assembly out of said locking orientation relative to the connector member.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
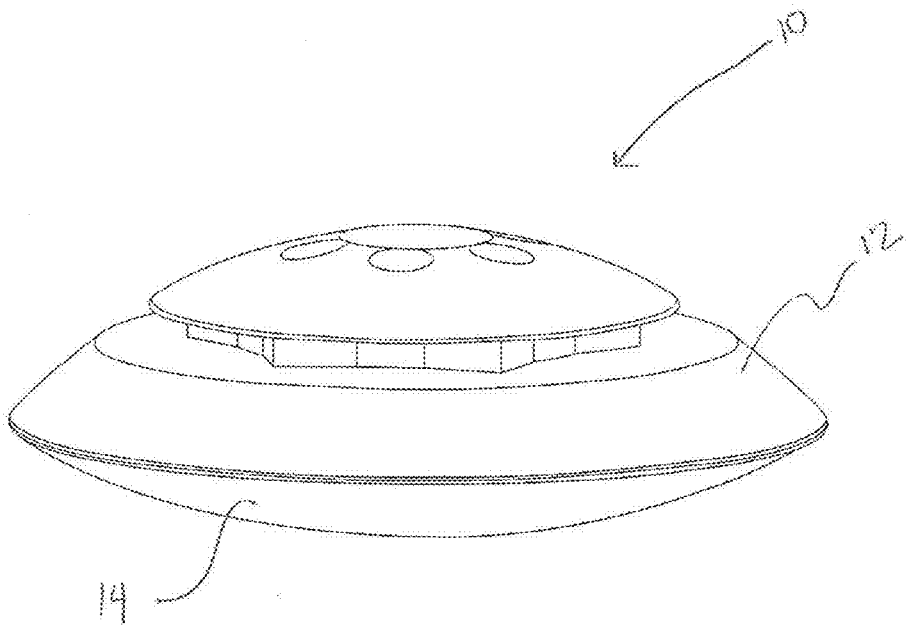
FIG. 1 is a perspective view of one preferred embodiment of the security tag assembly as disclosed in accordance with the present invention.
Figure 2:
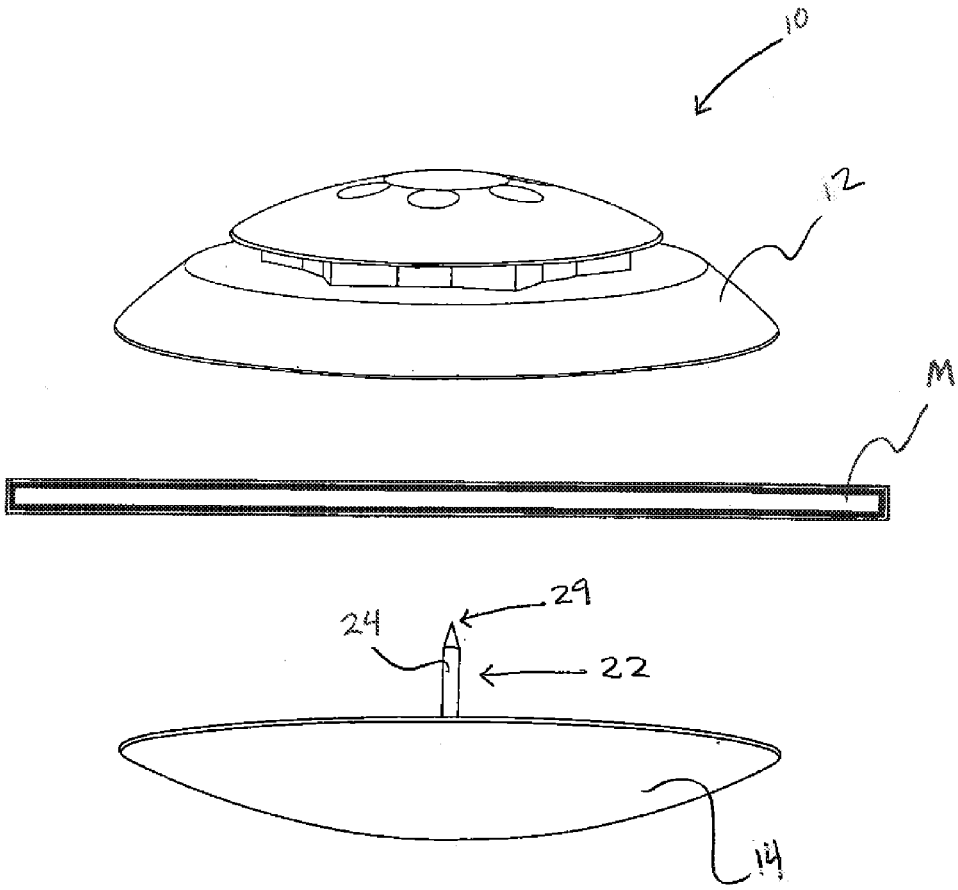
FIG. 2 is an exploded view of the security tag assembly illustrated in FIG. 1 showing the base and attachment member in an unassembled orientation.

As shown in the accompanying drawings, the present invention is directed towards a security tag assembly, generally indicated as 10, comprising at least one base 12 and at least one attachment or tag member 14. However, a practical application of the present invention would typically involve a plurality of bases 12 and a plurality of attachment or tag members 14, such as when a plurality of different products are being protected and/or monitored. Moreover, the security tag assembly 10 is of the type structured to be removably secured to various types of merchandise M so as to prevent unauthorized removal of the merchandise M from a given area or location. Typical applications for the security tag assembly 10 of the present invention include the interconnecting of one base 12 and any one of a plurality of attachment or tag members 14 to merchandise M being protected. As such, removal of the security tag assembly 10 from its operative position can be quickly and easily accomplished by authorized personnel using approved techniques or hardware. To the contrary, separation of the base 12 and the attachment member 14 from the operative position and the protected merchandise M is extremely difficult when attempted by unauthorized personnel.

In order to maintain a secure interconnection between the base 12 and the one or more attachment members 14, the attachment member 14 is provided with a connector member, generally indicated as 22, which, in at least one embodiment, comprises an elongated connector pin or like structure 24. The length of the connector member 22 is sufficient to extend outwardly from the attachment member 14 so as to engage and be properly connected to the base 12.

Cooperative structuring of each of the plurality of bases includes a passage or channel comprising a proximal end or opening 30 (at least partially illustrated in FIG. 6) configured for receipt of the connector member 22 therein and into an engaging relation with the base 12. The securing of the attachment member 14 in the preferred, operative position comprises penetration of the merchandise M by the connector pin 24 and continued travel of the connector pin 24 through the open proximal end 30 and into the interior of the base 12. Penetration of the merchandise M by the connector pin 24 as well as its passage into the base 12 may further be facilitated by a pointed or other appropriately shaped tip 29, as demonstrated.

Additional structural features of the present invention include the provision of a locking assembly, generally indicated as 36. The locking assembly 36 is disposed on or preferably within the interior of the base 12, such as between end caps 16 and 18 of base 12, and/or at least in communication with opening 30 so as to be disposed in receiving relation to the connector member 22. Therefore, as the connector pin is disposed into its connected, operative orientation relative to the base 12, it will pass through open end 30 (best illustrated in FIG. 6) and be received by the locking assembly 36 as the connector member 22 is passed there through.

Figure 4A:
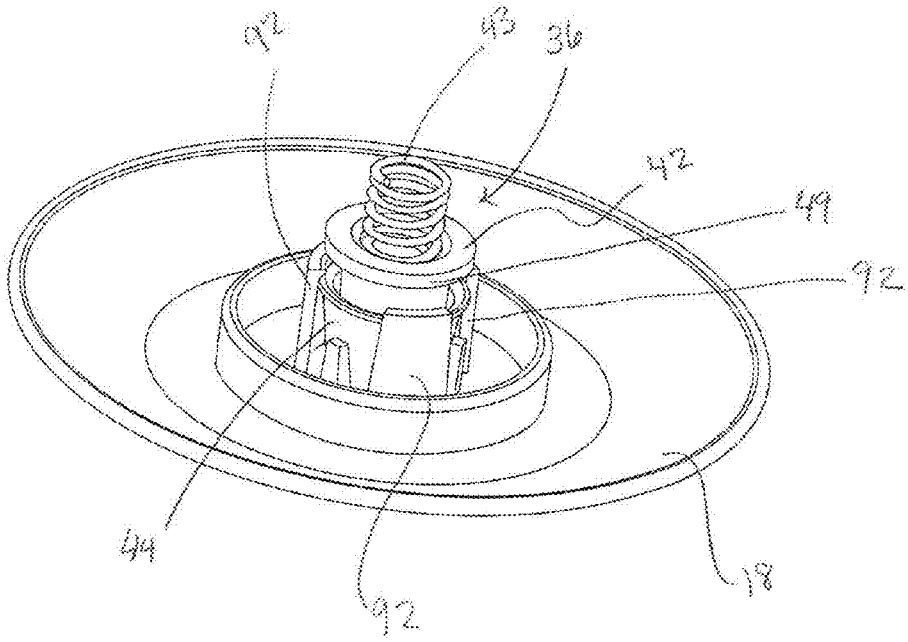
FIG. 4A is a partial perspective view of the locking assembly of at least one embodiment of the present invention (without illustrating the release assembly, for clarity).
Figure 4B:
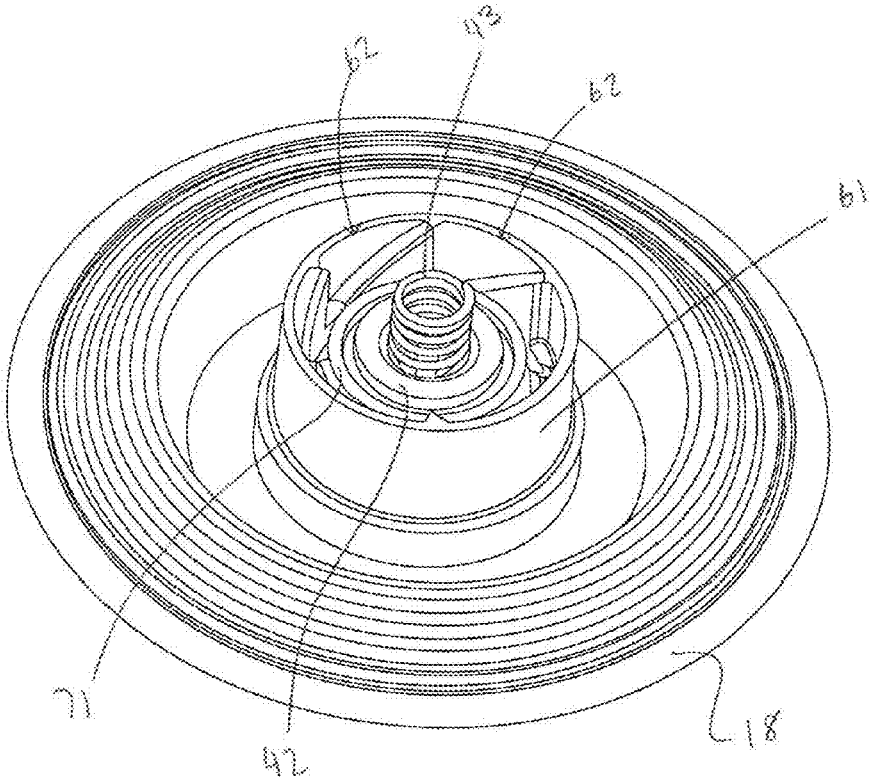
FIG. 4B is a partial perspective view of the embodiment illustrated in FIG. 4A (showing the release assembly).
Figure 5:
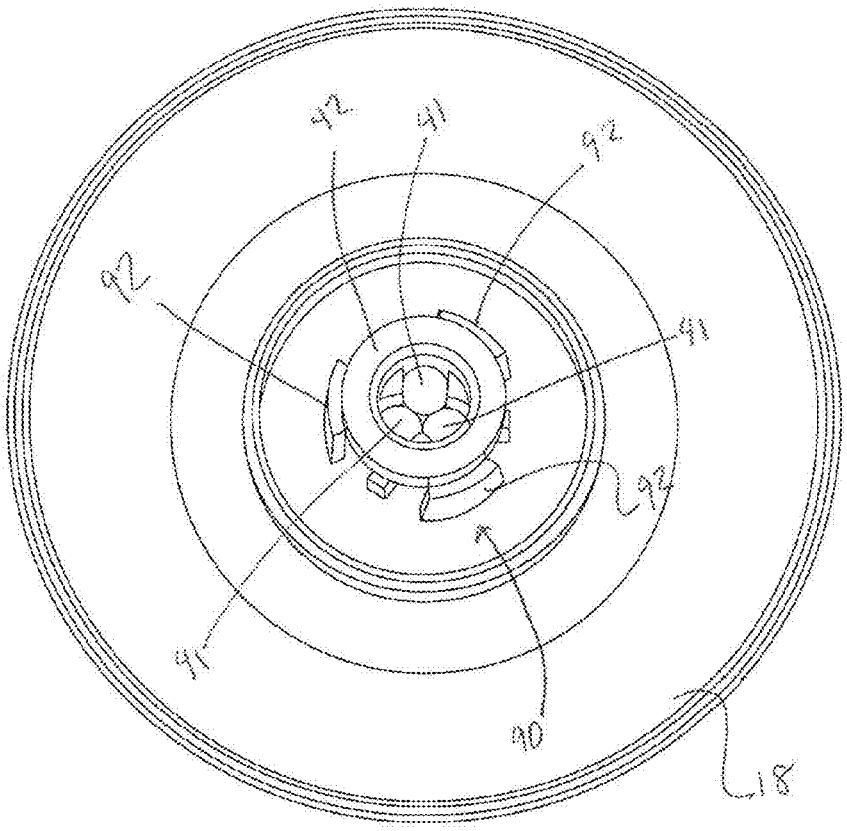
FIG. 5 is a top view of portions of the locking assembly of the embodiment illustrated in FIG. 4A.

In particular, the locking assembly 36 of the various embodiments of the present invention may include, for example, a plurality of locking members, such as ball-type locking members 41, disposed at least partially on the interior of a retention casing 42. In addition, a biasing member 43 serves to bias the locking members 41 and/or the retention casing 42 in a confronting, locking engagement with the exterior of the connector member 22 and thereby assume a locking orientation of the locking assembly 36. In particular, as shown in FIGS. 4A and 5 (which, for illustrative purposes only shows the locking assembly 36 without the interconnected release assembly 50) the retention casing 42 is disposed in a partially surrounding and/or engaging relation with the biasing member and in a retaining relation to the locking members 41. In addition, at least one embodiment further comprises a retention structure or seat 44 disposed in an at least partially surrounding and/or receiving relation to the retention casing 42 and/or locking members 41. As a result of the force exerted on the locking members 41 and/or retention casing 42 by the biasing member 43 the plurality of locking members 41 will be forced into the locking orientation and locking engagement with the exterior surface of the connector member 22. Accordingly, the locking assembly 36 can therefore be said to be normally biased into the locking orientation as represented herein. It should be noted that other locking assemblies not illustrated may be implemented in accordance with the present invention including, for example, a plurality of spaced apart retention fingers, one or more frictional rings, etc.

Figure 3A:
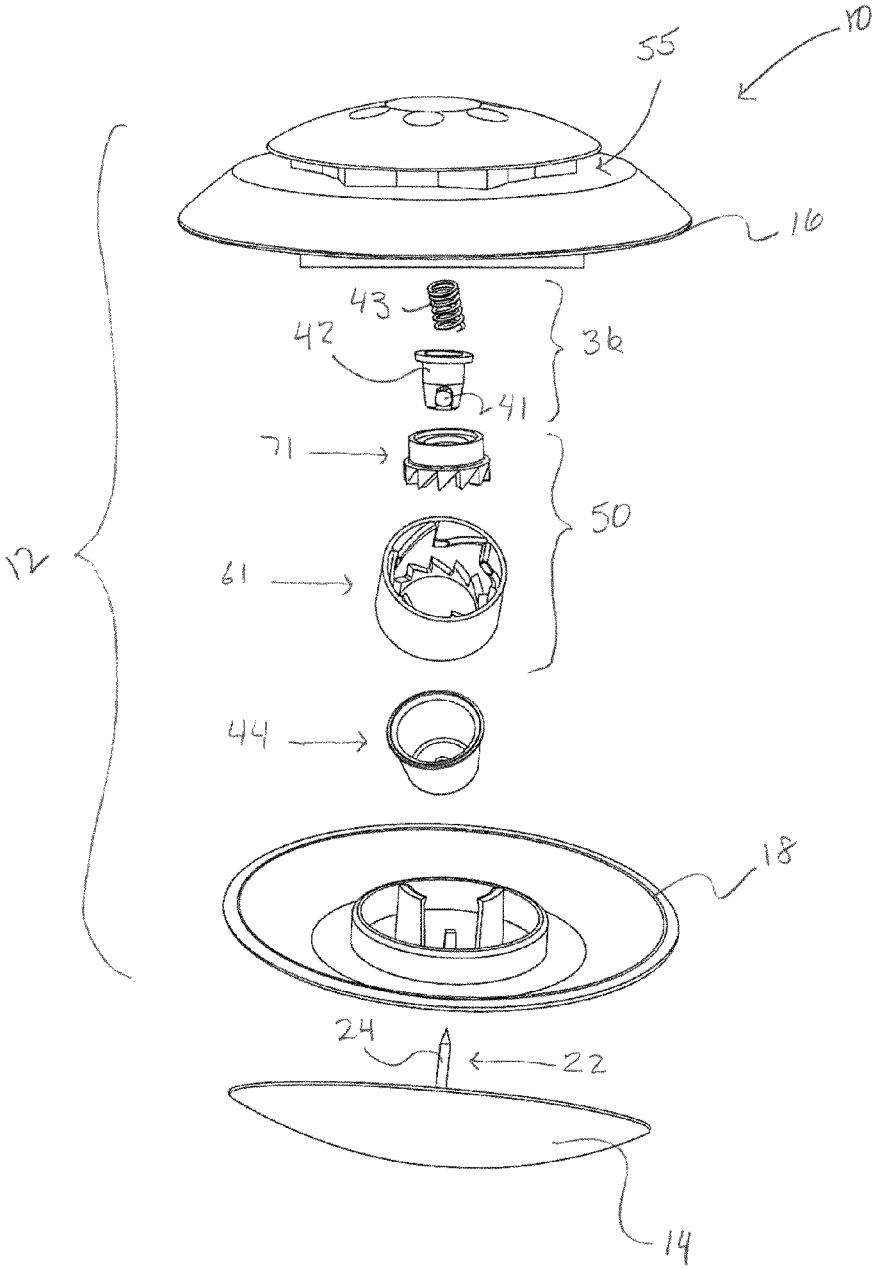
FIG. 3A is a partially exploded view of at least one embodiment of the present invention.
Figure 3B:
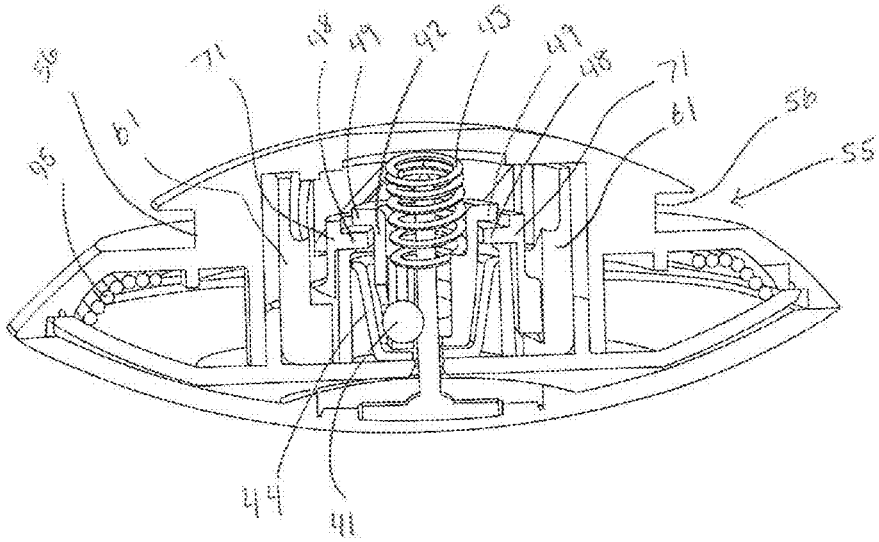
FIG. 3B is an interior sectional view in perspective of the security tag assembly.
Figure 6:
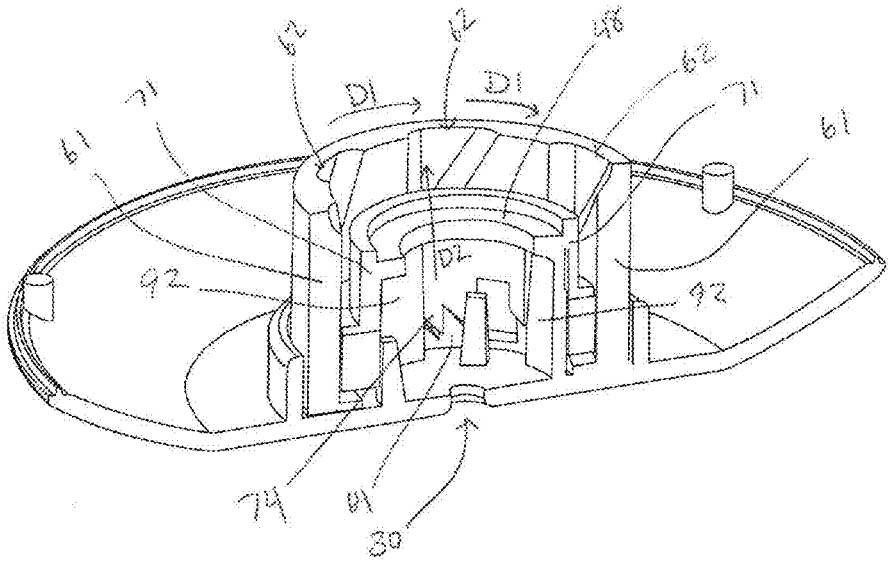
FIG. 6 is a partial cut away interior view illustrating the release assembly of at least one embodiment of the present invention (without illustrating the locking assembly, for clarity).

Referring again to FIG. 3A, additional structural features of the present invention include a release assembly 50 preferably disposed within the base 12, and in particular, at least partially between end caps 16 and 18 thereof. More in particular, the release assembly 50 is disposed in an at least partially engaging relation with at least a portion of the locking assembly 36, such as, but certainly not limited to, the retention casing 42 described above. For instance, in at least one embodiment, the release assembly 50 comprises an edge or lip 48 (illustrated in FIG. 6) which is engaged or confronted by a cooperatively structured lip or edge 49 (illustrated in FIG. 4A) of the retention casing 42. FIG. 6 illustrates the release assembly 50, however, for illustrative purposes only does not show the locking assembly 36 engaging lip 48. The inter-engagement or cooperative confrontation between edge 49 and lip 48 is shown in the partial cut-away view of FIG. 3B.

As will be described in greater detail hereinafter, the release assembly 50 comprises at least one, but more practically, a plurality of receiving channels, openings or passages, generally referenced as 62, which, as will be apparent from the following discussion, are utilized to facilitate the authorized release of the tag or attachment member 14 from the base 12, and disposition of the locking assembly 36 out of the locking orientation. Such authorized release and/or removal of the tag member 14 can be accomplished by utilization of an authorized, externally applied detachment assembly, generally referenced as 80. As described in greater detail herein, the detachment assembly 80 includes at least one, but preferably a plurality of at least two detachment members 82.

Particularly, in at least one embodiment, the release assembly 50 comprises at least two members or portions, such as a first, outer member 61 and a second inner member 71. Although first and second members 61, 71 may be integrally connected to one another as a single piece, in the preferred embodiment the two members 61, 71 are separate structures. In any event, the first and second members 61, 71 are joined or otherwise disposed in a movable, interlocked relation with one another such that movement of the first, outer member 61 causes the second, inner member to also move, as will be described hereinafter.

Figure 7A:
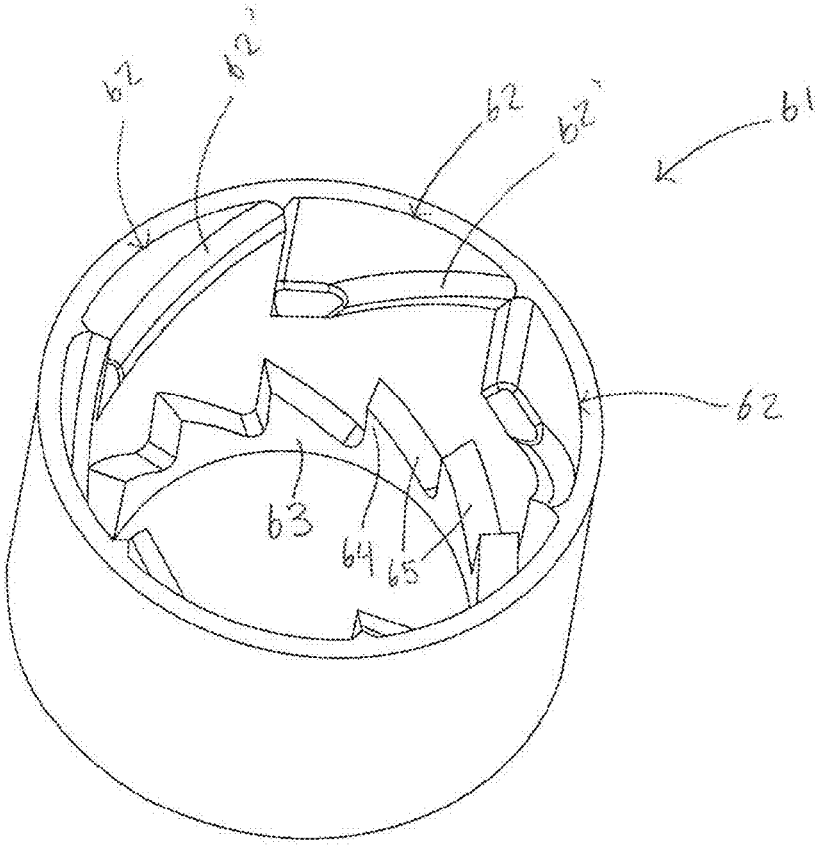
FIG. 7A is a top perspective view of the first, outer member of the release assembly of the embodiment illustrated in FIG. 6.

Specifically, in the embodiment illustrated in FIG. 6, the first, outer member 61 is disposed in an at least partially concentric or surrounding relation to the second, inner member 71. In addition, the two members 61, 71 are interlocked or interconnected with one another via cooperatively structured mating ends or portions 64, 74, respectively. For instance, as best illustrated in FIG. 7A, the first or outer member 61 comprises a ledge or lip 63 disposed at or proximate a bottom end thereof. The lip 63 includes mating end 64, such as upward facing "teeth" or angled or sloped surfaces 65. These "teeth" or angled surfaces 65 are utilized in conjunction with cooperatively structured "teeth" or angled surfaces 75 of the second member 71 (shown in FIG. 8, for example) in order to facilitate outward movement of the second member 71 upon rotational or other movement of the first member 61. While the angle of the "teeth" or mating surfaces may vary to accomplish the general purpose of the present invention, in at least one embodiment, the "teeth" comprise an angle of between 40 and 50 degrees, and preferably approximately 45 degrees.

Figure 9A:
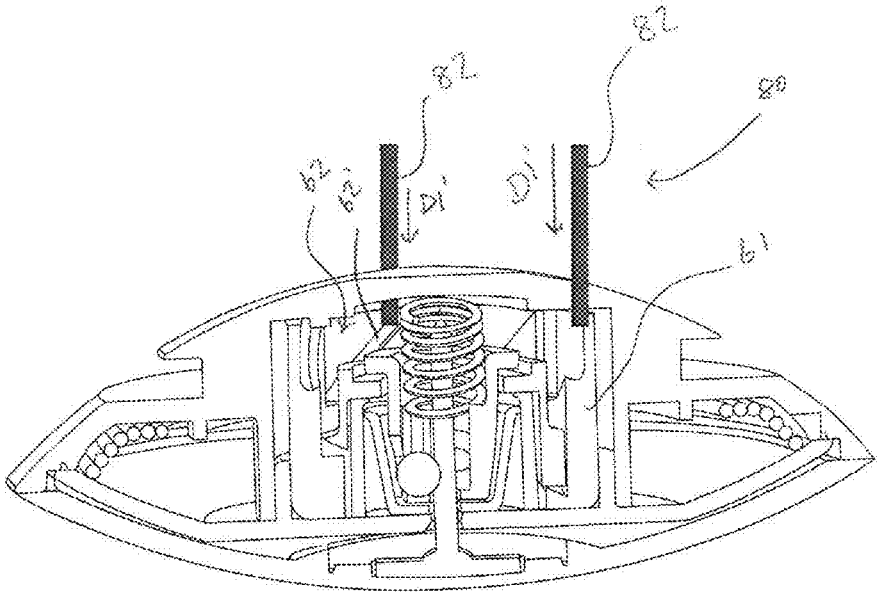
FIGS. 9A through 9B are partial interior views of the release assembly and locking assembly of at least one embodiment of the present invention.
Figure 9B:
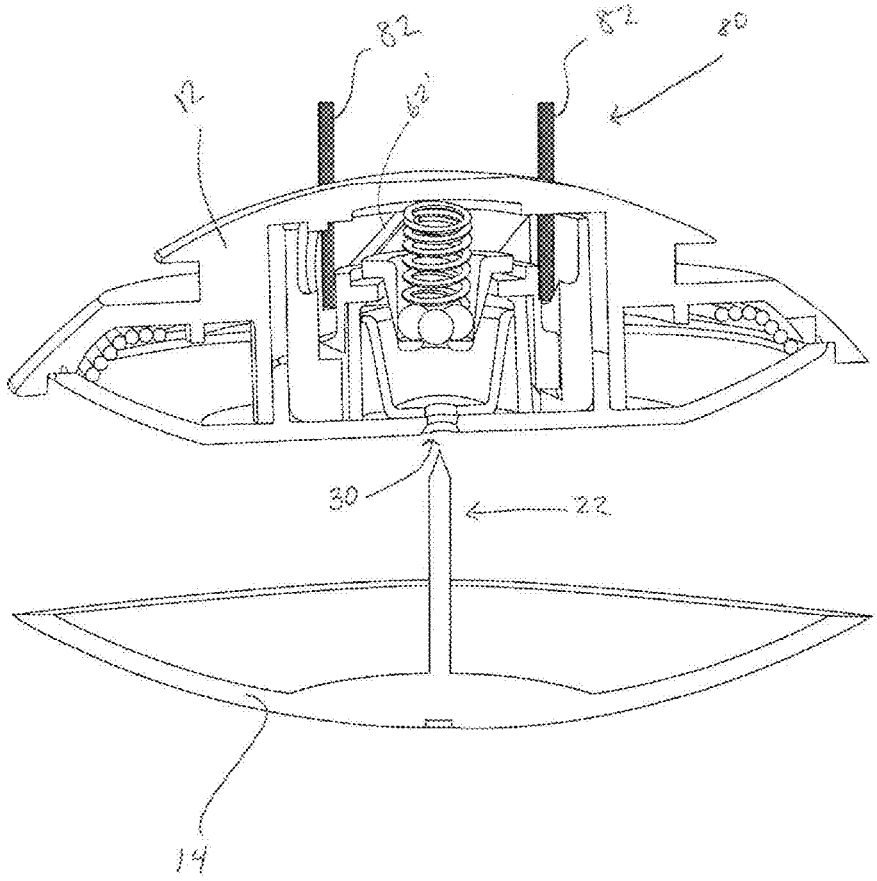
Figure 10:
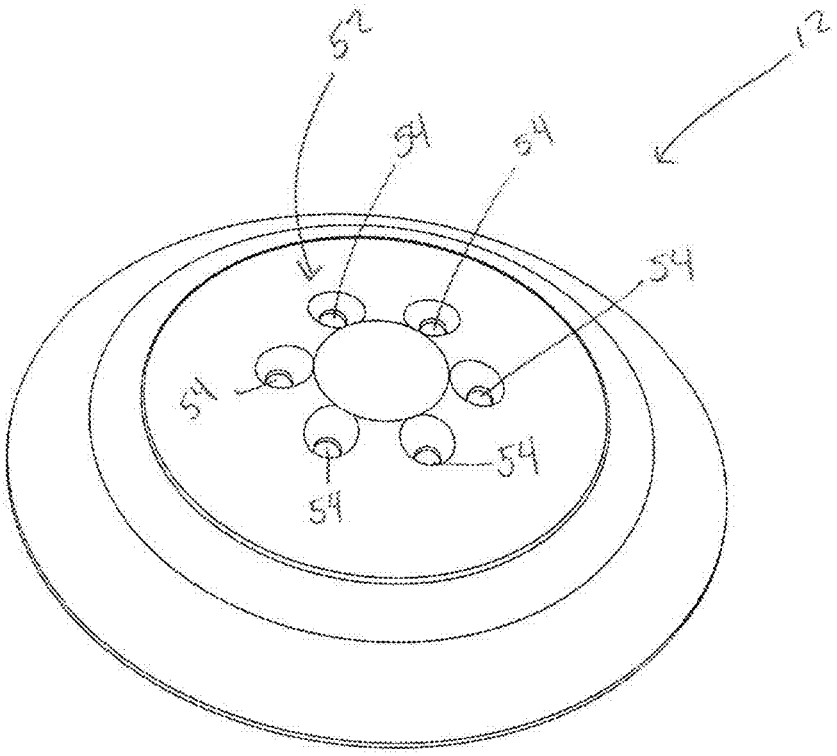
FIG. 10 is an outer perspective view of the base of at least one embodiment of the tag assembly as disclosed herein.

More in particular, as described briefly above, the first or outer member 61 comprises at least one, but preferably a plurality of receiving channels 62 structured for engagement with an externally applied detachment assembly 80. Specifically, the first member 61 is structured for movable and/or rotational disposition in a first, rotational direction (indicated, for example, by directional arrow D1 in FIG. 6) upon contact or engagement by the detachment assembly 80 (shown in FIGS. 9A and 9B). For instance, detachment member 82 of detachment assembly 80 will move or project toward the first member 61 in an at least partially linear direction D1 into the receiving channel 62 and will thereby contact or engage the first member 61 within receiving channel 62 and specifically, on a sloped or angled edge 62' within receiving channel 62. The continued linear force in direction D1' of the detachment member 82 upon the sloped or angled surfaces 62' of receiving channels 62 causes the first member 61 to move or rotate in direction D1 (shown in FIG. 6), for instance as the detachment member 82 slides or moves along a length of the sloped contact surface 62'.

Figure 7B:
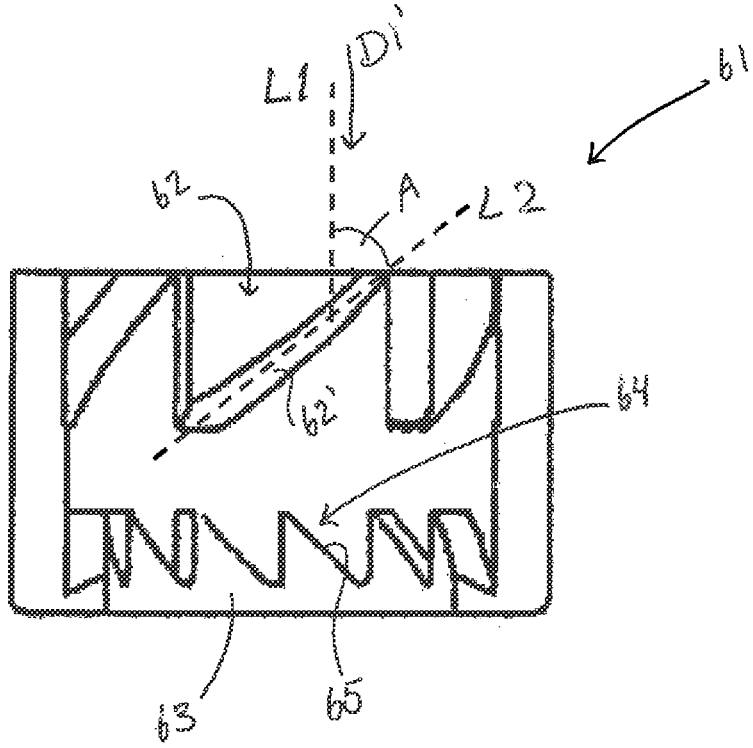
FIG. 7B is a side cut away view of the first, outer member of the release assembly illustrated in FIG. 7A.

To illustrate the angular or sloped orientation of the contact surface 62' of receiving channel 62, refer to FIGS. 7A and 7B. In particular, FIG. 7B shows a partial side cut-away view of the first, outer member 61 of at least one embodiment of the present invention. Again, D1' illustrates the at least partially linear and forced direction of travel of the detachment assembly 80 or detachment member 82 toward the sloped or angled contact surface 62'. Upon contact of the detachment assembly 80 with the contact surface 62', the first member 61 will be forced to rotate in direction D1 (shown in FIG. 6, for example) such that the detachment assembly 80, and in particular the corresponding detachment member 82, slides along or otherwise engages or contacts a length of the sloped surface of contact surface 62'. Still referring to FIG. 7B, reference lines L1 and L2 are presented to illustrate an angle "A" of the sloped contact surface 62'. In particular, line L1 is drawn parallel or along the plane of the sloped contact surface 62' and cross line L2 is drawn parallel to the direction of travel D1' for the detachment member 82.

As acute angle "A" illustrated in FIG. 7B gets smaller (i.e., closer to 0 degrees), the slope of the contact surface 62' gets steeper and the detachment member 82 will therefore slide along a length of the contact surface 62' easier. Conversely, as the angle "A" opens up or gets larger (i.e., closer to 90 degrees), the slope or angle of contact surface 62' gets smaller. In particular, the larger angle "A" gets or otherwise as angle "A" approaches 90 degrees (and, consequently, the smaller the slope of contact surface 62' gets), the harder it is for the detachment member 82 to slide along a length of the contact surface 62' and force the first member 61 to rotate, for example, in direction D1. Of course, the larger angle "A" gets as it approaches 90 degrees, the more difficult it may be for an unauthorized individual, knowing the interior locking and release mechanisms, to insert an object and force the first, outer member 61 to rotate. While the present invention may function properly utilizing a number of different angles A, in at least one embodiment, angle "A" comprises approximately 40 to 50 degrees, and preferably 45 degrees.

Furthermore, the interlocked, mating surfaces 64, 74 of first and second members 61, 71 respectively, are structured to dispose the second member 71 in a direction D2 different than direction D1, and into a displacing engagement with at least a portion of the locking assembly 36. In at least one embodiment, direction D2, which indicates or represents the direction of travel of second member 71, is directed in a substantially opposite direction than direction D1', which indicates or represents the direction of travel of the detachment member(s) 82. In particular, the displacing engagement of the second member 71 is sufficient to dispose the locking assembly 36 out of the locking orientation relative to the connector member 22 such that the attachment or tag member 14 may be easily removed from the base 12, and the tag assembly may be disconnected or disengaged from the merchandise M. Specifically, the displacing engagement of at least one embodiment is structured to dispose the locking assembly 36 and retention casing 42 against the force of the biasing member 43 so as to dislodge the frictional or forceful engagement of the locking member(s) 41 with the connector member 22.

In at least one embodiment, as best illustrated in FIG. 7A, the angular slope of surface 62' of the receiving channel 62 is disposed in a facing, transverse, or opposite direction than the sloped configuration or direction of surface 65 of the mating edge 64. These counter sloped configurations of at least one embodiment are structured to facilitate the operative rotational and outward movements of the first and second members 61, 71 respectively.

Additional structural features of at least one embodiment include a restriction assembly, generally referenced as 90, disposed in a restriction engaging relation the with the second, inner member 71 and being structured to restrict rotational movement of the second member 71. Specifically, upon rotational movement of the first, outer member 61 (e.g., upon contact of the detachment assembly 80 with the receiving channel(s) 62), due to the interlocked relation between the first and second members 61, 71, the second member 71 may initially tend or want to move in the same direction as the first member 61. The restriction assembly 90, however, is structured to restrict such movement of the second, inner member 71, and thereby cause the second member 71 to be disposed in the displacing engagement (e.g., along direction D2) with the locking assembly 36 by virtue of the cooperatively structured and sloped mating surfaces 64, 74.

Figure 8:
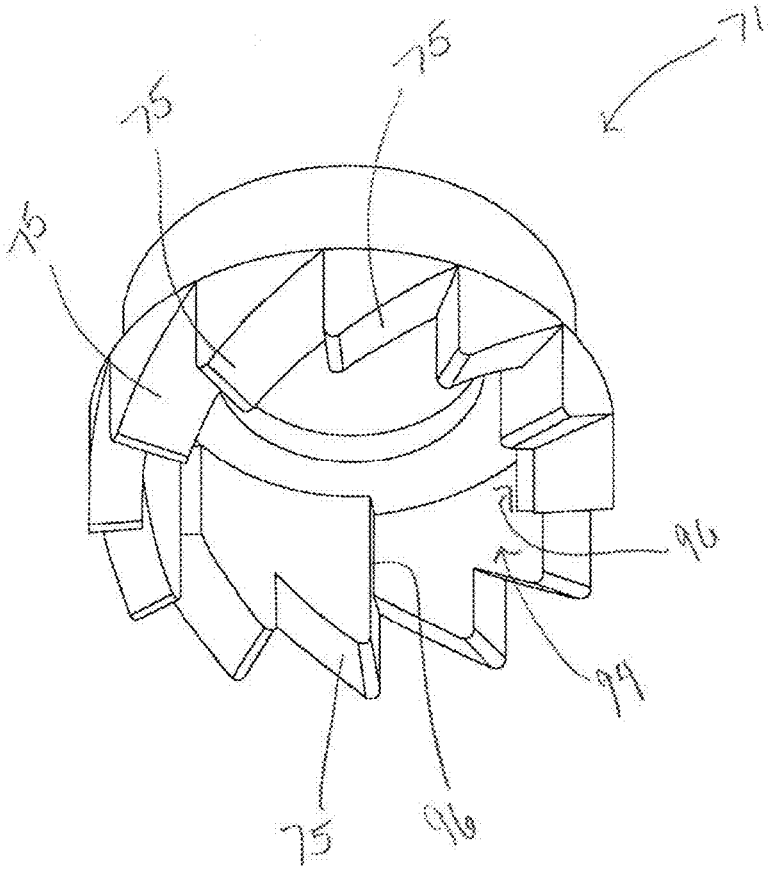
FIG. 8 is bottom perspective view of the second, inner member of the release assembly of the embodiment illustrated in FIG. 6.

In particular, the restriction assembly 90 of at least one embodiment comprises at least one, but more practically, a plurality of restriction members 92 and cooperatively structured restriction channels 94 (best shown in FIG. 8). In at least one embodiment, the restriction members 92 are disposed in a fixed relation to the inside of the base 12, including, but certainly not limited to, on the end cap 18 thereof, as generally illustrated in FIGS. 4A, 4B, 5 and 6. The restriction members 92 are therefore disposed in a connected or receiving relation within the cooperatively structured restriction channels 94, preferably, but not necessarily, disposed on the interior portion of the second member 71, as shown in FIG. 8. The restriction channels 94 are defined as indented portions between two opposing ledges or lips 96. Again, with the second member 71 restricted from rotational movement or other movement with the first member 61, upon movement of the first member 61 in a first rotational direction, due to the restriction assembly 90 and the mating surfaces 64, 74, the second member 71 will move in a different (outward) direction D2 and into the displacing engagement with the locking assembly 36. Accordingly, the mating ends 64, 74 are cooperatively structured to translate the rotational disposition of the first, outer member 61 into an outward disposition of the second, inner member 71 in order to dispose the second, inner member into the displacing engagement with the locking assembly 36.

The entire series of movements disposing the locking assembly 36 from the locked orientation to the unlocked or released orientation is accomplished by movement of the detachment member(s) 82 in a single direction D1'. The single direction D1' of at least one embodiment is in an opposing direction D2 of the movement enjoyed by the second, inner member 71 which disengages the locking assembly 36 from its locked orientation relative to the connector member 2. This allows for a simple and quick disconnection of the attachment member 14 from the base 12 with an authorized detachment assembly 80.

In order to further facilitate the authorized release of the tag member 14 from the base 12, due to the interaction of the attachment assembly 80 with the release assembly 50, the base 12 of at least one embodiment further includes an access assembly 52 comprising a plurality of access openings 54. Each of the plurality of access openings 54 is disposed in communicating relation with the interior portion of the base 12. In addition, at least some of the access openings 54 are disposed in an at least partially aligned relation with one or more the receiving channels 62 of the first, outer member 61. In particular, the access openings 54 of at least one embodiment are at least partially aligned with the sloped or angled surface 62' of the receiving channels 62. As a result of such at least partial alignment, the passage of the detachment member 82 through access openings 54 will result in at least a portion (e.g., the end tip) of the detachment member 82 coming into interacting, confronting, engagement or contact with the first member 61, and in particular, the sloped or angled surface 62' of the receiving channel 62. As described above, such contact results in a rotational movement or disposition of the first member 61 in a first direction D1, thereby causing the second member 71 to be disposed in an outward direction D2 (toward the detachment member 82) and releasing the locking assembly 36 from the locking orientation relative to the connector member 22.

Additional structural features of the tag assembly 10 of the present invention include an alignment assembly, generally referenced at 55. The alignment assembly extends at least partially or completely about the indicated exterior, accessible portion of the base 12. Moreover, the alignment assembly 55 is disposed, dimensioned and configured to be correctly oriented in a detachment assembly 80. More specifically, the alignment assembly 55 includes an exterior surface 56 having a predetermined configuration and/or dimension to be received within a receiving assembly 84 associated with the detachment assembly 80.

In operation, the upper portion or upper end cap 16 of the base 12 passed along or into a trough or like receiving area 85. When so disposed, the predetermined exterior surface 56 of the alignment assembly 55 will be forced into a "correct" or predetermined alignment with the receiving ledge, lip or flange 84. The predetermined surface configuration 56 cooperates with the dimension or configuration of the lip or flange 84 so as to properly align the access assembly 52, and in particular, the access opening(s) 54, with the plurality of detachment members 82 (not illustrated in FIG. 11). For example, the exterior surface of the alignment assembly 55 may include any of a variety of multi-sided configurations which, when disposed within and engaging the lip or flange 84 will serve to automatically align at least some of the plurality of access openings 54 with the detachment members 82.

To further facilitate the alignment of at least some of the plurality of access openings 54 with the detachment members 82, the detachment assembly 80 may comprise one or more locking devices 87, for example, disposed within receiving area or channel 85. In particular, the locking device 87 may act as a push-button or automatically retractable flange which is structured to automatically retract upon contact with the tag assembly 10 as the tag assembly 10 slides or moves through channel 85 toward ledge 84. Once the tag assembly 10 clears or otherwise passes the locking device 87 such that one or more access openings 54 are aligned with the detachment members 82, the locking device 87 will be disengaged by the tag assembly 10 and be disposed in an outward, blocking orientation relative to the tag assembly 10. Accordingly, the tag assembly 10 will be locked within the detachment assembly 80 and at least one, but more practically two access openings 54 are aligned with the detachment members 82. Thus, upon actuation of the detachment assembly 80 such that the detachment members penetrate the access openings 54, as described above, the base 12 and attachment member 14 may be easily removed from one another.

Figure 11:
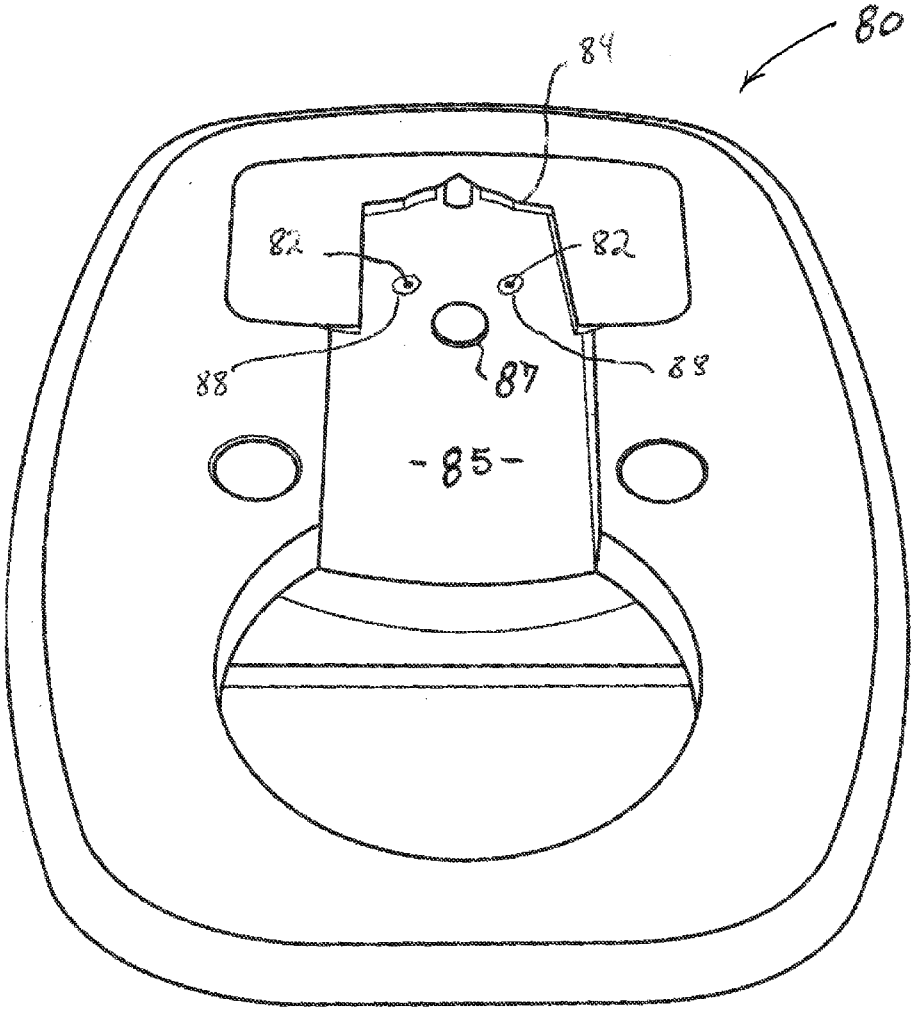
FIG. 11 is a perspective view of at least a portion of a detachment assembly absent representation of the detachment members.

Further with regard to FIG. 11, the detachment members 82 may pass through the apertures 88 in the receiving area 85 and into and through the aligned access openings 54 as described herein. The detachment assembly 80, as represented in FIG. 11, may assume any of a plurality of different structures and configuration structured to facilitate the practice of the present invention in the intended manner.

The various embodiments of the present invention may further include an alarm activating assembly, generally referenced as 95, and may include, for example, the provision of a coil or other structure which includes alarm activating capabilities and/or radio frequency signaling capabilities. As such, the alarm activating assembly is preferably disposed within the interior of the base 12 and in a non-accessible location.

Other similar devices may be utilized, including devices comprising data storage capabilities (e.g. to provide inventory, purchase, location, origin of supplier or manufacturer, or other merchandise data) and/or ink releasing capabilities structured to stain or otherwise mark a garment or merchandise to which the security tag assembly 10 is attached.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security tag assembly structured to restrict unauthorized removal of a product from an area, said security tag assembly comprising:

a base including a locking assembly, said locking assembly structured to be biased into a locking orientation, a tag member including an elongated connector member structured to pass through the product and into a locking position, said locking position comprising said connector member passing into said base and into a removable locking engagement with said locking assembly when in a locking orientation, a release assembly disposed within said base, said release assembly comprising first and second members disposed in a movable interlocked relation with one another, said first member of said release assembly being structured for movable disposition upon engagement by an externally applied detachment assembly, said second member being disposed into a displacing engagement with at least a portion of said locking assembly upon movable engagement of said first member with the detachment assembly, and said displacing engagement sufficient to dispose said locking assembly out of said locking orientation relative to said connector member, and said first member of said release assembly including at least one receiving channel structured for engagement with the detachment assembly.

2. The security tag assembly as recited in claim 1 wherein said at least one receiving channel comprises a sloped contact surface, wherein said first member is structured to be movably disposed in a first direction upon engagement of the detachment assembly with said sloped contact surface.

3. The security tag assembly as recited in claim 2 wherein said second member of said release assembly is structured to be movably disposed in a second direction and into said displacing engagement upon disposition of said first member in said first direction.

4. The security tag assembly as recited in claim 3 wherein said first and said second members of said release assembly comprise cooperatively structured mating ends for disposition of said first and said second members in movable interlocked engagement with one another.

5. The security tag assembly as recited in claim 4 wherein said cooperatively structured mating ends comprises a plurality of sloped edges.

6. The security tag assembly as recited in claim 5 wherein said mating ends are structured to dispose said second member into said displacing engagement upon disposition of said first member in said first direction.

7. The security tag assembly as recited in claim 1 wherein said first member of said release assembly comprises a plurality of said receiving channels each structured and disposed for engagement with a different one of a plurality of detachment members of the detachment assembly.

8. The security tag assembly as recited in claim 7 wherein each of said receiving channels comprises a sloped edge, wherein said first member is rotationally disposed upon engagement of the detachment members with said sloped edge of at least two of said receiving channels.

9. The security tag assembly as recited in claim 8 wherein said second member of said release assembly is disposed in an outward direction relative to said elongated connector member and into said displacing engagement upon said rotational disposition of said first member.

10. The security tag assembly as recited in claim 9 wherein said first and said second members of said release assembly each comprise cooperatively structured mating ends for disposition of said first and said second members in movable interlocked engagement with one another.

11. The security tag assembly as recited in claim 10 wherein said mating ends are structured to translate said rotational disposition of said first member into said outward disposition of said second member in order to dispose said second member into said displacing engagement.

12. The security tag assembly as recited in claim 11 further comprising a restriction assembly disposed in an engaging relation with said second member and structured to restrict rotational disposition of said second member.

13. The security tag assembly as recited in claim 1 wherein said base comprises a plurality of access openings disposed and dimensioned to facilitate passage of a plurality of detachment members therethrough into movable engagement with said first member of said release assembly.

14. The security tag assembly as recited in claim 13 wherein said first member of said release assembly comprises a plurality of said receiving channels each structured and disposed for engagement with a different one of the plurality of detachment members.

15. The security tag assembly as recited in claim 14 wherein at least two of the plurality of access openings of said base are disposed in an at least partially aligned relation with at least some of said plurality of receiving channels.

16. The security tag assembly as recited in claim 15 wherein said receiving channels are cooperatively configured to rotationally dispose said first member upon engagement of the detachment assembly therewith.

17. The security tag assembly as recited in claim 16 wherein said first and said second members comprise cooperatively structured mating portions.

18. The security tag assembly as recited in claim 17 wherein said mating portions of said first and said second members are configured to dispose said second member in an outwardly direction and into said displacing engagement.

19. A security tag assembly structured to restrict unauthorized removal of a product from an area, said security tag assembly comprising:

a base including a locking assembly, said locking assembly structured to be biased into a locking orientation, a tag member including an elongated connector member structured to pass through the product and into a locking position, said locking position comprising said connector member passing into said base and into a removable locking engagement with said locking assembly when in a locking orientation, a release assembly disposed within said base and structured for movable disposition upon contact by an externally applied detachment assembly, said release assembly comprising a first portion and a second portion, said first portion being disposed in at least partially rotational movement upon contact with the externally applied detachment assembly, and said second portion being disposed into a displacing engagement with at least a portion of said locking assembly upon said rotational movement of said first portion, and said displacing engagement being sufficient to dispose said locking assembly out of said locking orientation relative to said connector member, and a restriction assembly disposed in an engaging relation with said second portion and structured to restrict rotational disposition of said second portion.

20. The security tag assembly as recited in claim 19 wherein said first portion of said release assembly comprises a plurality of receiving channels each structured and disposed for engagement with a different one of a plurality of detachment members.

21. The security tag assembly as recited in claim 20 wherein said receiving channels are cooperatively configured to rotationally dispose said first portion upon contact of the detachment assembly therewith.

22. The security tag assembly as recited in claim 21 wherein each of said receiving channels comprises a sloped contact surface structured for engagement with the detachment assembly.

23. The security tag assembly as recited in claim 22 wherein said sloped contact surface comprises an angular orientation of between forty and fifty degrees relative to a linear directional movement of the detachment assembly disposed in said engagement therewith.

24. The security tag assembly as recited in claim 21 wherein said first and said second portions are disposed in a movable interlocked relation to one another.

25. The security tag assembly as recited in claim 24 wherein said first and said second portions comprise cooperatively structured mating portions structured to dispose said first and said second portions into said movable interlocked relation.

26. The security tag assembly as recited in claim 25 wherein said mating portions of said first and said second portions of said release assembly are configured to dispose said second portion in an outwardly direction and into said displacing engagement.

* * * * *